US010994964B2

(12) United States Patent
Thakare et al.

(10) Patent No.: US 10,994,964 B2
(45) **Date of Patent: *May 4, 2021**

(54) METHOD OF INSTALLING CABLE ON CABLE REEL

(71) Applicant: Amphenol Corporation, Wallingford, CT (US)

(72) Inventors: Rakesh Thakare, Cary, NC (US); Caichun Song, Changzhou (CN); Phillip S. Bowen, Chatham, VA (US); Marvin Bryant, Chatham, VA (US); Paul R. Boucher, Callands, VA (US); Barry Holt, Ottawa (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/073,471

(22) Filed: Oct. 19, 2020

(65) Prior Publication Data

US 2021/0032074 A1 Feb. 4, 2021

Related U.S. Application Data

(60) Continuation of application No. 16/804,577, filed on Feb. 28, 2020, which is a continuation of application (Continued)

(51) Int. Cl.
*B65H 75/22* (2006.01)
*B65H 75/14* (2006.01)

(Continued)

(52) U.S. Cl.
CPC ..... *B65H 75/30* (2013.01); *B65H 49/205* (2013.01); *B65H 49/305* (2013.01);

(Continued)

(58) Field of Classification Search
CPC .... B65H 49/205; B65H 49/305; B65H 75/14; B65H 75/22
See application file for complete search history.

(56) References Cited

U.S. PATENT DOCUMENTS 1,990,135 A 2/1935 Sato
2,033,578 A 3/1936 Kittel (Continued)

FOREIGN PATENT DOCUMENTS

DE 4001250 A1 * 7/1991 ..... B65H 54/103
EP 0922003 A1 6/1999
EP 2017211 A1 1/2009

OTHER PUBLICATIONS

Machine Translation of DE 40 01 250 A1, Jul. 25, 1991. (Year: 1991).*

(Continued)

*Primary Examiner* — William E Dondero
(74) *Attorney, Agent, or Firm* — Blank Rome LLP

(57) ABSTRACT

A method of installing cable on a cable reel apparatus that includes providing a pre-wound, reel-less coil of cable for installing on a separable cable reel. The cable reel includes a first flange that is configured to be rotatably coupled to a first frame, and the first flange has opposite inner and outer sides, and a second flange that is separate from the first flange and is configured to be rotatably coupled to a second frame, and the second flange has opposite inner and outer sides. One of the first and second flanges includes a hub portion that extends transversely from the inner side thereof. The method also includes instructing a user to releasably couple the first and second flanges to support the pre-wound, reel-lees coil of cable on the hub portion between the first and second flanges along the central longitudinal axis of the separable cable reel.

20 Claims, 10 Drawing Sheets

Related U.S. Application Data

No. 15/833,091, filed on Dec. 6, 2017, now Pat. No. 10,589,957, which is a continuation of application No. 15/433,789, filed on Feb. 15, 2017, now Pat. No. 9,862,566, which is a division of application No. 14/634,007, filed on Feb. 27, 2015, now Pat. No. 9,695,008.

(51) Int. Cl.

| | |
|---|---|
| ***B65H 49/20*** | (2006.01) |
| ***B65H 49/32*** | (2006.01) |
| ***B65H 49/30*** | (2006.01) |
| ***B65H 75/30*** | (2006.01) |
| ***B65H 75/24*** | (2006.01) |
| ***B65H 59/04*** | (2006.01) |

(52) U.S. Cl.

CPC ..... *B65H 49/322* (2013.01); *B65H 49/325* (2013.01); *B65H 59/04* (2013.01); *B65H 75/14* (2013.01); *B65H 75/22* (2013.01); *B65H 75/242* (2013.01); *B65H 75/245* (2013.01)

(56) References Cited

U.S. PATENT DOCUMENTS

| | | | |
|---|---|---|---|
| 2,268,547 | A | 1/1942 | Haines |
| 2,400,417 | A | 5/1946 | Hickey |
| 2,952,420 | A | 9/1960 | Von Hoorn |
| 2,965,331 | A | 12/1960 | Nagy |
| 3,693,784 | A | 9/1972 | Holmes |
| 3,696,697 | A | 10/1972 | Hoffman |
| 3,836,093 | A | 9/1974 | Mozina et al. |
| 4,650,073 | A | 3/1987 | Young |
| 4,667,896 | A | 5/1987 | Frey et al. |
| 5,139,210 | A | 8/1992 | Schaffer |
| 5,464,171 | A | 11/1995 | Ripplinger |
| 5,704,479 | A | 1/1998 | Barnett |
| 5,775,621 | A | 7/1998 | Sauber |
| 5,810,283 | A | 9/1998 | Shea |
| 6,045,087 | A | 4/2000 | Vislock |
| 6,145,780 | A | 11/2000 | Fontana |
| 6,234,421 | B1 | 5/2001 | Cox |
| 6,241,181 | B1 | 6/2001 | Campbell |
| 6,328,238 | B1 | 12/2001 | Chism |
| 6,352,215 | B1 | 3/2002 | Cash |
| 6,523,777 | B2 | 2/2003 | Gaudi |
| 7,140,598 | B2 | 11/2006 | Verakis et al. |
| 7,204,452 | B2 | 4/2007 | Wilkinson et al. |
| 7,891,601 | B2 | 2/2011 | Higashisaka et al. |
| 7,938,357 | B2 | 5/2011 | Johanson et al. |
| D641,161 | S | 7/2011 | Houston et al. |
| D641,162 | S | 7/2011 | Houston et al. |
| D641,163 | S | 7/2011 | Houston et al. |
| 8,016,222 | B2 | 9/2011 | Galgano |
| 8,230,996 | B1 | 7/2012 | Cummings et al. |
| 8,251,212 | B2 | 8/2012 | Dunlap |
| 8,366,126 | B2 | 2/2013 | Galgano et al. |
| 8,371,519 | B2 | 2/2013 | McManus |
| 8,387,909 | B2 | 3/2013 | Galgano et al. |
| 8,424,795 | B2 | 4/2013 | Galgano et al. |
| D686,907 | S | 7/2013 | Chastain et al. |
| 9,637,343 | B2 | 5/2017 | Allwood |
| 9,862,566 | B2 | 1/2018 | Thakare |
| 9,873,588 | B2 | 1/2018 | Thakare |
| 9,908,737 | B2 | 3/2018 | Chastain |
| 10,239,725 | B2 | 3/2019 | Chastain |
| 10,689,223 | B2 | 6/2020 | Chastain et al. |
| 2005/0035240 | A1 | 2/2005 | Weck |
| 2006/0157366 | A1 | 7/2006 | Jamie |
| 2006/0231672 | A1 | 10/2006 | Eastwood |
| 2007/0018031 | A1 | 1/2007 | Sycko |
| 2010/0078514 | A1 | 4/2010 | Thompson |
| 2010/0314484 | A1 | 12/2010 | Houston |
| 2010/0320309 | A1 | 12/2010 | Galgano et al. |
| 2011/0240791 | A1 | 10/2011 | Lindley |
| 2012/0091249 | A1 | 4/2012 | Crosset |
| 2012/0153069 | A1 | 6/2012 | Allwood |
| 2012/0168554 | A1 | 7/2012 | Blunt |
| 2014/0312159 | A1 | 10/2014 | Troitzsch et al. |
| 2015/0312159 | A1 | 10/2015 | Ertugay et al. |
| 2015/0321876 | A1 | 11/2015 | Galindo Gonzalez |

OTHER PUBLICATIONS

Perfect Tote by PPC Broadband, Inc.; 2 pages.
Axjo Cable Reel, "Attachment A"; 1 page.
Times Fiber Communications; Innovative Broadband Solutions; Tech Service Bag, pp. 1-2.

* cited by examiner

METHOD OF INSTALLING CABLE ON CABLE REEL

RELATED APPLICATIONS

This application is a continuation of application Ser. No. 16/804,577, filed Feb. 28, 2020, which is a continuation of application Ser. No. 15/833,091, filed Dec. 6, 2017, now U.S. Pat. No. 10,589,957, which is a continuation of application Ser. No. 15/433,789, filed Feb. 15, 2017, now U.S. Pat. No. 9,862,566, which is a divisional of U.S. application Ser. No. 14/634,007, entitled Cable Reel, filed on Feb. 27, 2015, now U.S. Pat. No. 9,695,008, the content of each of which is relied upon and incorporated herein by reference in their entirety.

BACKGROUND

Cable installers are commonly required to carry cable to installation locations. The installers usually use some type of shoulder bag or other types of packing solutions with an opening for paying out the cable. These cables are often wound on a reel to form a cable coil and packaged in a box or bag for payout during installations. The installer may, however, payout too much cable if the installer pulls too hard on the cable.

Therefore, a need exists for a cable reel that allows for easy installation of cable in a bag or the like.

SUMMARY

Accordingly, the present disclosure may provide a cable reel that has first and second opposing flanges. The first flange has a first hub portion and the second flange has a second hub portion. The first and second hub portions are axially aligned and configured to mate with one another to support cable, such as a cable coil. The first hub portion includes an elongated wall that extends from the first flange. The elongated wall is sized to support the cable. The elongated wall defines an inner area that is configured to accept the second hub portion. The elongated wall includes a plurality of flexible segments. The second hub portion includes a truncated wall that is receivable in the inner area of the first hub portion. The truncated wall includes a tapered outer surface for engaging and expanding the plurality of flexible segments.

The present disclosure may also provide a cable reel that includes at least one support frame that has an outwardly extending braking gear member. The outwardly extending gear member is located off-center on the frame. A first flange has a central opening and a first hub portion that surrounds the central opening. The central opening has an internal braking gear member that engages the outwardly extending gear member of the frame, thereby rotatably coupling the at least one support frame and the first flange. A second flange opposes the first flange and has a second hub portion. The first and second hub portions are configured to mate with one another to support cable. The engagement of the gear members provides a friction for cable payoff.

The present disclosure may further provide a method of installing the cable, such as a cable coil, on a cable reel that includes the steps of providing a cable reel that includes first and second opposing flanges, the first flange having a first hub portion and the second flange having a second hub portion, the first hub portion being longer than the second hub portion, and the first hub portion having a plurality of flexible segments; placing a cable coil over the first hub portion and on the first flange so that the first hub portion extends through the cable coil; and inserting the second hub portion inside of the first hub portion, thereby expanding the flexible segments so that the flexible segments engage the cable coil.

The present disclosure may yet further provide a method of installing cable on a cable reel that comprises the steps of providing a cable reel that includes first and second opposing flanges where the first flange has a first hub portion and the second flange having a second hub portion and the first hub portion has one or more flexible segments; placing a cable coil over the first hub portion and on the first flange so that the first hub portion substantially extends through an inner diameter of the cable coil; and expanding the one or more flexible segments by inserting the second hub portion inside of the first hub portion so that the one or more flexible segments engage the cable coil.

The present disclosure may also further provide a method of installing cable on a cable reel, that comprises the steps of providing a cable reel that includes first and second frames that rotatably support first and second opposing flanges, respectively, where the first flange has a first hub portion and the second flange has a second hub portion and the first hub portion has an elongated wall that defines a receiving area for a truncated wall of the second hub portion; placing a cable coil over the first hub portion and on the first flange so that the first hub portion substantially extends through an inner diameter of the cable coil; and inserting the truncated wall of the second hub portion inside of the receiving area of the first hub portion, thereby retaining the cable coil between the first and second frames such that the cable coil rotates with respect to the first and second frames, thereby allowing payout of the cable of the cable coil.

The present disclosure relates to a method of installing a coil of cable in a bag, that comprises the steps of: placing a coil of cable on a first hub of a first flange of the cable reel; placing a second flange of the cable reel, that is separable from the first flange, opposite from the first flange to hold the coil of cable on the first hub of the first flange; positioning the first flange on or next to a first support frame received in the bag; and placing the second flange on or next to a second support frame received in the bag. The second support frame is positioned in the bag such that the first flange, the coil of cable and the second flange are located between the first support frame and the second support frame.

In some examples, the method further comprises the step of engaging the first and second flanges after placing the second flange opposite from the first flange, thereby holding the coil of cable between the first and second flanges; the step of engaging the first and second flanges includes snapping the first and second flanges together; the step of engaging the first and second flanges includes engaging a second hub of the second flange with the first hub of the first flange; and/or the first hub of the first flange is an elongated wall.

In other examples, the method further comprises the step of disengaging the first flange from the second flange; further comprises the step of disengaging the first flange from the second flange after opening the bag; and/or further comprises the steps of rotatably coupling the first flange and the first frame and rotatably coupling the second flange and the second frame.

The present disclosure relates to a method of installing a coil of cable in a bag, that comprises the steps of: placing a coil of cable on a first hub of a first flange of the cable reel; placing a second flange of the cable reel opposite from the first flange to hold the coil of cable on the first hub of the first flange; positioning the first flange on or next to a first support frame located in the bag; and placing the second flange on or next to a second support frame located in the bag, wherein the second support frame is positionable in the bag such that the first flange, the coil of cable and the second flange are located between the first support frame and the second support frame. The step of placing the coil of cable on the first hub of the first flange occurs before the step of positioning the first flange on the first support frame.

In certain examples, the step of placing the second flange of the cable reel opposite from the first flange to hold the coil of cable on the first hub of the first flange includes engaging a second hub of the second flange with the first hub; and/or the method further comprises the step of disengaging the second hub from the first hub after opening the bag.

The present disclosure relates to a method of installing a coil of cable in a bag, the bag having a cover for opening the bag, a base opposite the cover, and sides extending between the cover and the base, the comprises the steps of: placing a coil of cable on a first hub of a first flange of the cable reel; placing a second flange of the cable reel, that is separable from the first flange, opposite from the first flange to hold the coil of cable on the first hub of the first flange; positioning the first flange on or next to a first support frame received in the bag, the first support frame being on an inner surface the base of the bag; and placing the second flange on or next to a second support frame received in the bag, the second support frame being on an inner surface of the cover of the bag. When the cover of the bag is closed, the first flange, the coil of cable and the second flange are located between the first support frame and the second support frame inside the bag.

In some examples, the method further comprises the step of engaging the first and second flanges after placing the second flange opposite from the first flange, thereby holding the coil of cable between the first and second flanges; the step of engaging the first and second flanges includes engaging a second hub of the second flange with the first hub of the first flange; the method further comprises the step of disengaging the first flange from the second flange; the method further comprises the step of opening the bag by opening the cover and the step disengaging the first flange from the second flange occurs after opening the bag; and/or the method further comprises the steps of rotatably coupling the first flange and the first frame and rotatably coupling the second flange and the second frame.

In other examples, the coil of cable is prepacked with a plastic wrap prior to the step of placing the coil of cable on the first hub of the first flange; and/or the method further comprises the step of dispensing the cable through a payout slot in the bag.

The present disclosure may yet further relate to a method of installing a cable reel in a bag, the cable reel comprising a first flange with a first hub portion and a second flange with a second hub portion, the method can comprise the steps of: placing the first flange on a first support frame secured to a base of the bag, wherein either the first hub portion or the second hub portion includes an elongated wall and the other of the first hub portion and the second hub portion includes a truncated wall; and releasably coupling the elongated wall and the truncated wall together to form a hub member configured to support a coil of cable.

In certain examples, the elongated wall and the truncated wall are releasably coupled by a friction fit therebetween; the method further comprises the step of placing the coil of cable on the elongated wall prior to the step of releasably coupling the elongated wall and the truncated wall together; the method further comprises the step of dispensing cable of the cable coil through a payout slot in the bag after the step of releasably coupling the elongated wall and the truncated wall together; the method further comprises the step of decoupling the elongated wall and the truncated wall from one another for replacement of the coil of cable with another coil of cable; at least a portion of the truncated wall is received in a receiving area of the elongated wall when releasably coupling the elongated wall and the truncated wall together; the elongated wall is an annular wall and the truncated wall is an annular wall; the first frame and the elongated wall are integral, and the second frame and the truncated wall are integral; the first hub portion includes a first engagement member configured to engage a second engagement member of the second hub portion; and/or the method further comprises the step of locking the first flange to the second flange.

The present disclosure may also relate to a method of installing a cable reel in a bag, that can comprise the step of releasably coupling a hub portion of a first flange of the cable reel with a second flange of the cable reel, the hub portion being configured to support a coil of cable; placing a coil of cable on the hub portion; and placing the first flange on a first support frame secured to the bag for dispensing the cable from the bag.

In some examples, the hub portion comprises wall; the step of releasably coupling the hub portion and the second flange includes inserting another hub portion of the second flange into a receiving area of the hub portion of the first flange; the step of releasably coupling the first hub portion includes coupling the hub portion and another hub portion of the second flange by a friction fit; the hub portion includes a first engagement member configured to engage a second engagement member of another hub portion of the second flange; the first flange and the hub portion form one-piece; and/or the step of placing the coil of cable on the hub portion occurs before releasably coupling the hub portion and the second flange.

The present disclosure may further relate to a method of installing a coil of cable in a bag, that can comprise the steps of: placing a pre-wound, reel-less coil of cable on a hub portion of a first flange; after placing the coil of cable on the hub portion of the first flange, releasably coupling the hub portion to a second flange, to form a hub that holds the coil of cable between the first and second flanges; and placing the first flange and the second flange with the coil of cable therebetween into the bag.

In certain examples, the method further comprises the step of positioning the first flange on or next to a first support frame received in the bag, the first support frame being on an inner surface a base of the bag; and/or the method further comprises the step of positioning the second flange on or next to a second support frame received in the bag, the second support frame being on an inner surface of a cover of the bag, wherein, when the cover of the bag is closed, the first flange, the coil of cable and the second flange are located between the first support frame and the second support frame inside the bag.

In other examples of the method, the reel-less coil of cable is pre-wound prior to the step of placing the coil of cable on the hub portion of the first flange; the method further comprises the step of dispensing cable of the coil of cable from the bag; the method further comprises the step of decoupling the hub portion and the second flange; the method further comprises the step of placing another pre-wound reel-less coil of cable on the hub portion after the step of decoupling the hub portion and the second flange; the hub portion comprises an elongated wall; the step of releasably coupling the hub portion and the second flange comprises releasably coupling the hub portion with another hub portion of the second flange; and/or the hub portion and the another hub portion form a friction fit.

The present disclosure may also provide a method of installing a coil of cable in a bag, that can comprise the steps of providing a user with a cable reel, the cable reel comprising a first flange and a second flange, the first flange having a hub member configured to releasably couple to the second flange; instructing the user to place the coil of cable on the hub member and then releasably couple the hub member with the second flange with the coil of cable between the first and second flanges; and instructing the user to place the cable reel with the coil of cable into the bag for dispensing of the cable. In the example, the method further comprises the step of providing the user the coil of cable that is pre-wound and reel-less.

An aspect of the present disclosure is a method of installing cable on a cable reel apparatus that comprises the steps of providing a pre-wound, reel-less coil of cable for installing on a separable cable reel. The separable cable reel comprises a central longitudinal axis, a first flange configured to be rotatably coupled to a first frame, and the first flange has opposite inner and outer sides, and a second flange that is separate from the first flange and is configured to be rotatably coupled to a second frame, and the second flange has opposite inner and outer sides. At least one of the first and second flanges includes a hub portion that extends transversely from the inner side thereof. The method also includes the step of instructing a user to releasably couple the first and second flanges to support the pre-wound, reel-lees coil of cable on the hub portion between the first and second flanges along the central longitudinal axis of the separable cable reel.

In certain examples, the method further comprises the step of instructing the user to decouple the first and second flanges from one another when replacing the pre-wound, reel-less coil of cable once dispensed from the cable reel apparatus; the pre-wound, reel-less coil of cable has an inner diameter, and the hub portion is sized to be received in the inner diameter when releasably coupling the first and second flanges for supporting pre-wound, reel-less the coil of cable; the method further comprises the step of prepackaging the pre-wound, reel-less coil of cable; and/or the step of prepackaging the pre-wound, reel-less coil of cable includes wrapping the pre-wound, reel-less coil of cable with plastic.

In other examples, the method further comprises the step of providing a bag sized to receive the separable cable reel and the pre-wound, reel-less coil of cable; the method further comprises the step of instructing the user to place the first frame on a first inner surface of the bag and place the second frame on another second inner surface of the bag; the bag has a base and a cover, and the base includes the first inner surface the cover includes the second inner surface; the method further comprises the step of instructing the user to dispense cable of the pre-wound, reel-less coil of cable through a payout opening in the base of the bag; the method further comprises the step of instructing the user to close the cover on the base of the bag when releasably coupling the first and second flanges; the method further comprises the step of instructing the user to open the cover from the base of the bag when decoupling the first and second flanges; the hub portion is an annular elongated wall; and/or the first and second flanges are releasably coupled by a friction fit.

Another aspect of the present disclosure is a method of installing cable on a cable reel apparatus that comprises the steps of providing a bag having a base, a cover, a payout opening sized for dispensing cable, a first frame, and a second frame; providing a pre-wound, reel-less coil of cable for installing on a separable cable reel. The separable cable reel comprises a first flange for positioning on the first frame, the first flange has an inner side and an outer side, the outer side of the first flange for faces the first frame, a second flange that is separate from the first flange for positioning on the second frame, the second flange having an inner side and an outer side, the outer side of the second flange for facing the second frame, and at least one of the first and second flanges includes a hub portion that extends transversely from an inner side thereof. The method also comprises instructing a user to releasably couple the first and second flanges to support the pre-wound, reel-lees coil of cable on the hub portion between the first and second flanges along a central longitudinal axis of the separable cable reel.

In some examples, the method further comprises the step of instructing the user to decouple the first and second flanges from one another when replacing the pre-wound, reel-less coil of cable once dispensed from the cable reel apparatus, the method further comprises the step of instructing the user to place the first frame on an inner surface of base of the bag and place the second frame on an inner surface of the cover of the bag; the method further comprises the step of prepackaging the pre-wound, reel-less coil of cable; the method further comprising the step of instructing the user to dispense cable of the pre-wound, reel-less coil of cable through a payout opening in the base of the bag; the method further comprises the step of instructing the user to close the cover on the base of the bag when releasably coupling the first and second flanges; and/or the method further comprises the step of instructing the user to open the cover from the base of the bag when decoupling the first and second flanges.

A further aspect of the present disclosure is a method of installing cable on a cable reel apparatus that comprises providing a bag having a base, a cover, a payout opening sized for dispensing cable, a first frame, and a second frame; and providing a pre-wound, reel-less coil of cable for installing on a separable cable reel. The separable cable reel comprises a first flange for positioning on the first frame, and the first flange has an inner side and an outer side, and the inner side of the first flange includes a first hub portion, and the outer side of the first flange for facing the first frame; and a second flange that is separate from the first flange for positioning on the second frame, and the second flange has an inner side and an outer side, and the inner side of the second flange includes a second hub portion, and the outer side of the second flange for facing the second frame; and at least one of the first and second flanges includes a hub portion extending transversely from an inner side thereof. The method also comprises the step of instructing a user to releasably couple the first and second hub portions to form a hub member to support the pre-wound, reel-lees coil of cable between the first and second flanges along a central longitudinal axis of the separable cable reel.

In an example, the first hub portion is an elongated annular wall and the second hub portion is a truncated annular wall.

Yet another aspect of the present disclosure is a method of installing cable on a cable reel apparatus that comprises the steps of configuring the cable reel apparatus to have: a bag; a first frame configured to be received inside the bag; a first flange configured to be removably engaged with the first frame; a second frame configured to be received inside the bag; a second flange configured to be removably engaged with the second frame; and a hub member configured to releasably couple the first flange with the second flange, the hub member configured to support a coil of cable. The method also comprises providing a pre-wound, reel-less coil of cable.

In an example, the method further comprises instructing a user to install the coil of cable on the cable reel apparatus by decoupling the first flange from the second flange, placing the coil of cable on the hub member, and coupling the first flange to the second flange.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Figure 1:
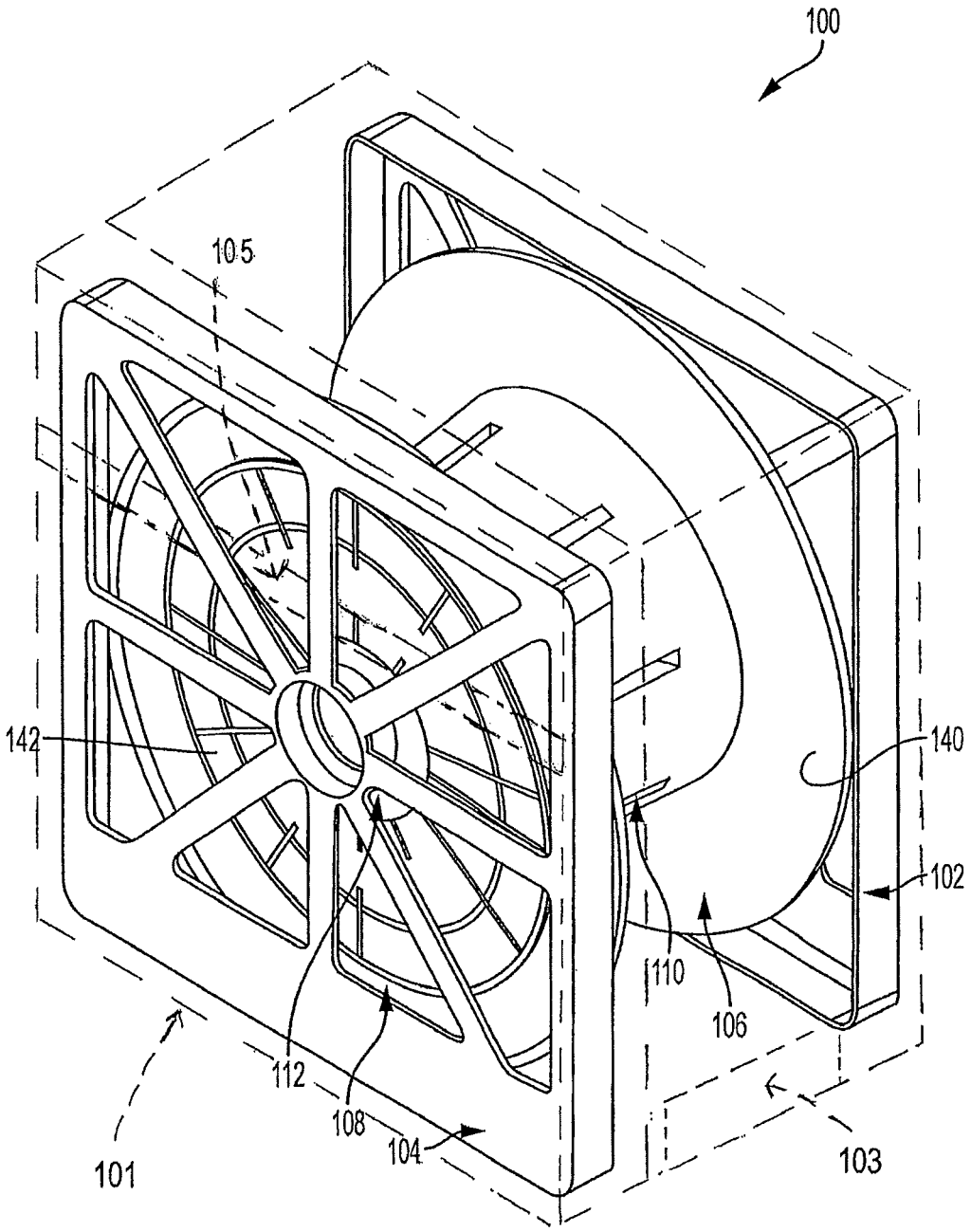
FIG. 1 is a perspective view of a cable reel in accordance with an example of the present disclosure, shown without a supporting bag or box.

The present disclosure relates to a method of installing a coil of cable in a bag, that comprises the steps of: placing a coil of cable on a first hub of a first flange of the cable reel; placing a second flange of the cable reel, that is separable from the first flange, opposite from the first flange to hold the coil of cable on the first hub of the first flange; positioning the first flange on or next to a first support frame received in the bag; and placing the second flange on or next to a second support frame received in the bag. The second support frame is positioned in the bag such that the first flange, the coil of cable and the second flange are located between the first support frame and the second support frame.

The present disclosure relates to a method of installing a coil of cable in a bag, that comprises the steps of: placing a coil of cable on a first hub of a first flange of the cable reel; placing a second flange of the cable reel opposite from the first flange to hold the coil of cable on the first hub of the first flange; positioning the first flange on or next to a first support frame located in the bag; and placing the second flange on or next to a second support frame located in the bag, wherein the second support frame is positionable in the bag such that the first flange, the coil of cable and the second flange are located between the first support frame and the second support frame. The step of placing the coil of cable on the first hub of the first flange occurs before the step of positioning the first flange on the first support frame.

The present disclosure relates to a method of installing a coil of cable in a bag, the bag having a cover for opening the bag, a base opposite the cover, and sides extending between the cover and the base, the comprises the steps of: placing a coil of cable on a first hub of a first flange of the cable reel; placing a second flange of the cable reel, that is separable from the first flange, opposite from the first flange to hold the coil of cable on the first hub of the first flange; positioning the first flange on or next to a first support frame received in the bag, the first support frame being on an inner surface the base of the bag; and placing the second flange on or next to a second support frame received in the bag, the second support frame being on an inner surface of the cover of the bag. When the cover of the bag is closed, the first flange, the coil of cable and the second flange are located between the first support frame and the second support frame inside the bag.

Referring to FIGS. 1-3, 4A, 4B, 5A, 5B, and 6-8, the present disclosure relates to a cable reel 100 that may be carried in a conventional shoulder bag or satchel, a cardboard or plastic box, and the like 101, with an opening 103 for easy payout of cable supported on the cable reel. The cable reel 100 according to one example of the present disclosure is designed to provide easy installation of cable C, such as a cable coil, on the reel 100 and also prevents overpayout of the cable. Because the cable reel 100 is designed to be carried by an installer, it is preferable that the components of the cable reel 100 be formed of lighter weight materials, such as plastic. Some exemplary plastic materials include polyethylene, polypropylene, ABS or other polymer products.

As seen in FIG. 1, the cable reel 100 generally includes opposing support frames 102 and 104 that rotatably support first and second flanges 106 and 108 with a hub member 110 therebetween on which the cable is held. A braking mechanism 112 is preferably provided on the reel 100 between the support frames 102 and 104 of the flanges 106 and 108 to limit overpayout of the cable. The cable reel 100 may be inserted into and supported by the payout bag or box wherein the support frames 102 and 104 are attached, preferably removably attached, to the cover and base, respectively, of the bag.

Figure 2:
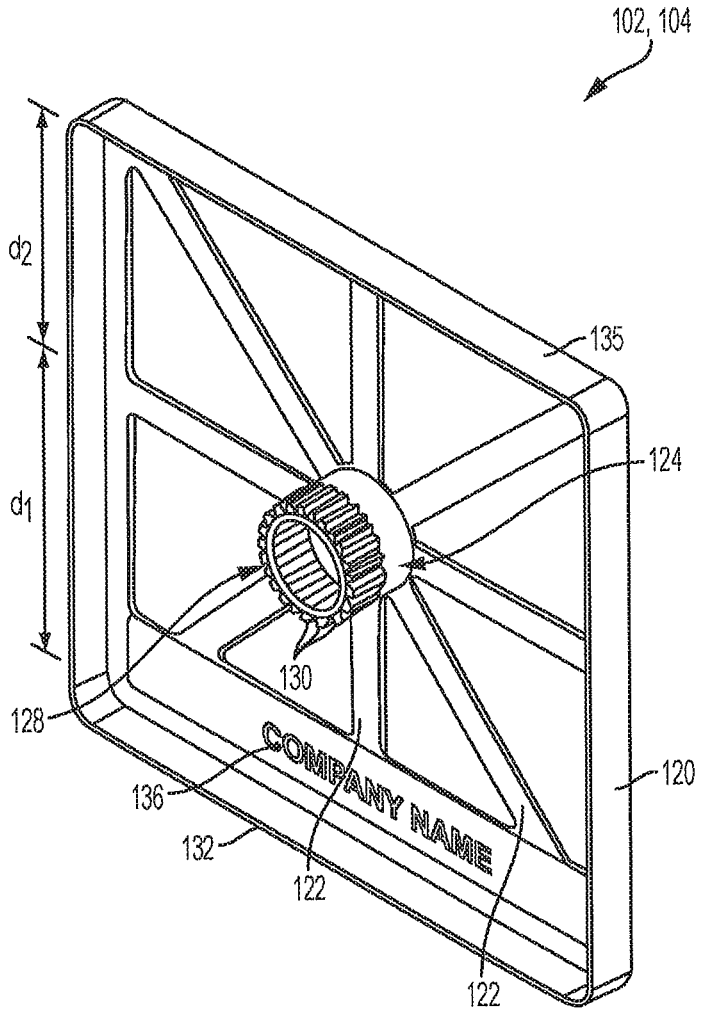
FIG. 2 is a perspective view of a support frame of the cable reel illustrated in FIG. 1.
Figure 3:
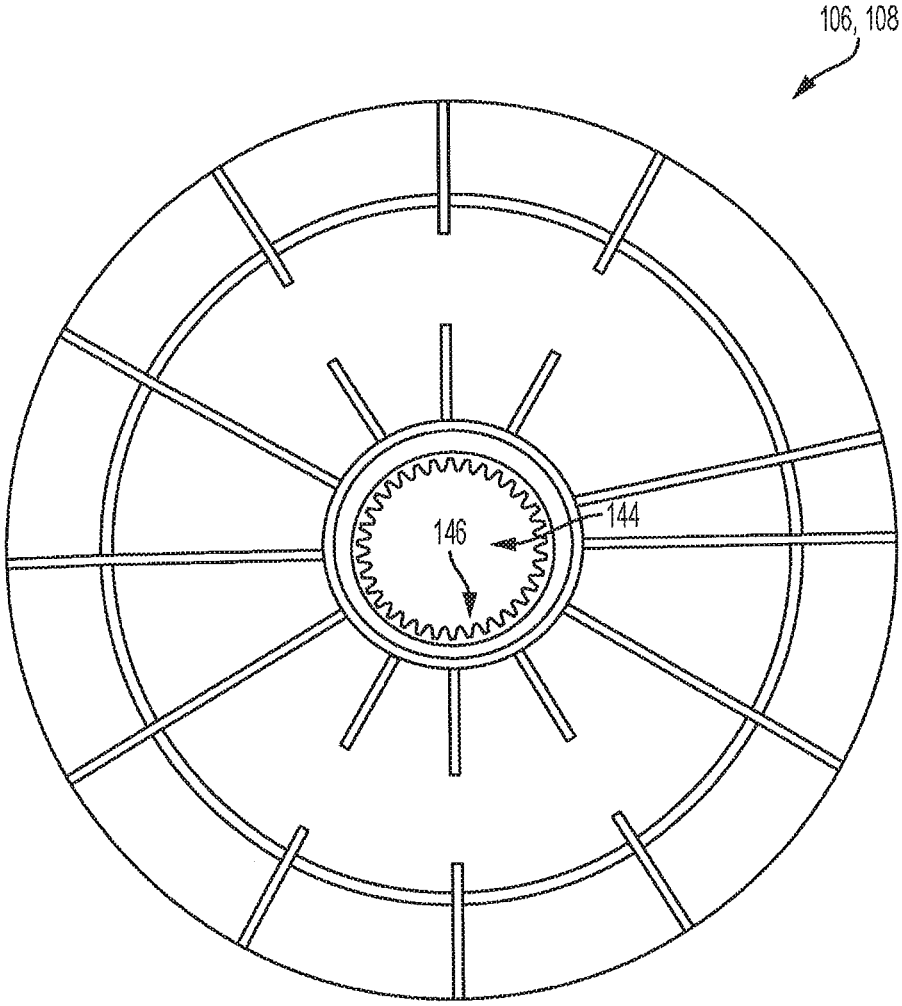
FIG. 3 is an elevational view of a flange of the cable reel illustrated in FIG. 1.
Figure 6:
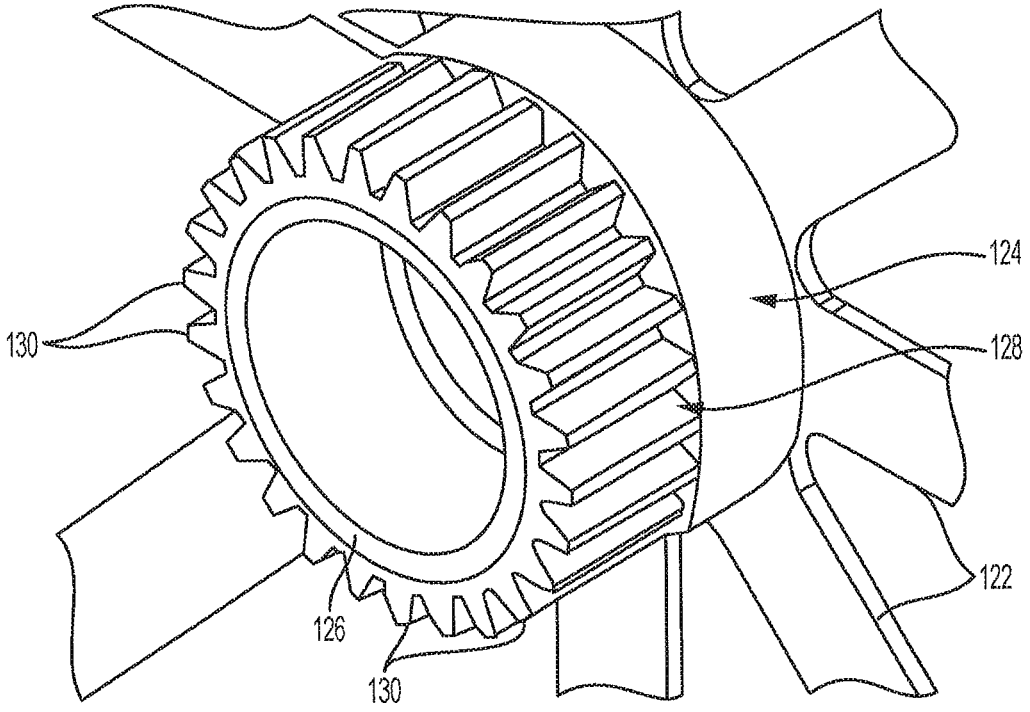
FIG. 6 is an enlarged partial perspective view of the frame illustrated in FIG. 2, showing outer gears of the frame.
Figure 7:
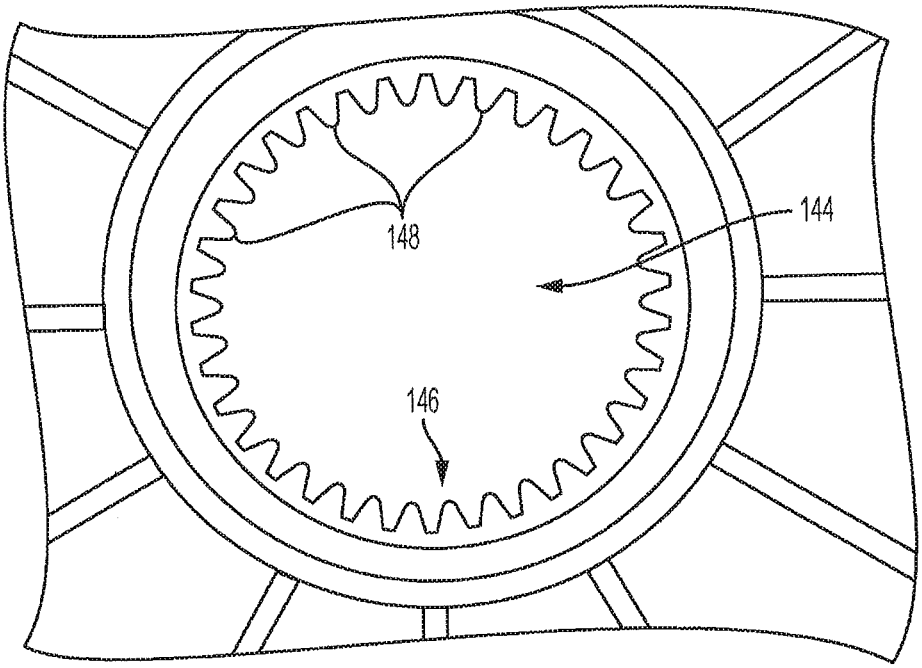
FIG. 7 is an enlarged partial side elevational view of the flange illustrated in FIG. 3, showing the inner gears of the flange.

As seen in FIGS. 2 and 6, each support frame 102 and 104 includes an outer frame portion 120 with one or more cross members 122 and a middle flange support 124. The outer frame portion 120 may have a substantially square geometry. The middle flange support 124 includes an annular extension 126 (FIG. 6) that supports a first part of the braking mechanism 112. The first part of the braking mechanism may be an outwardly extending gear member 128 that includes a plurality of annularly arranged teeth 130 extending radially outwardly from the annular extension 126.

Figure 8:
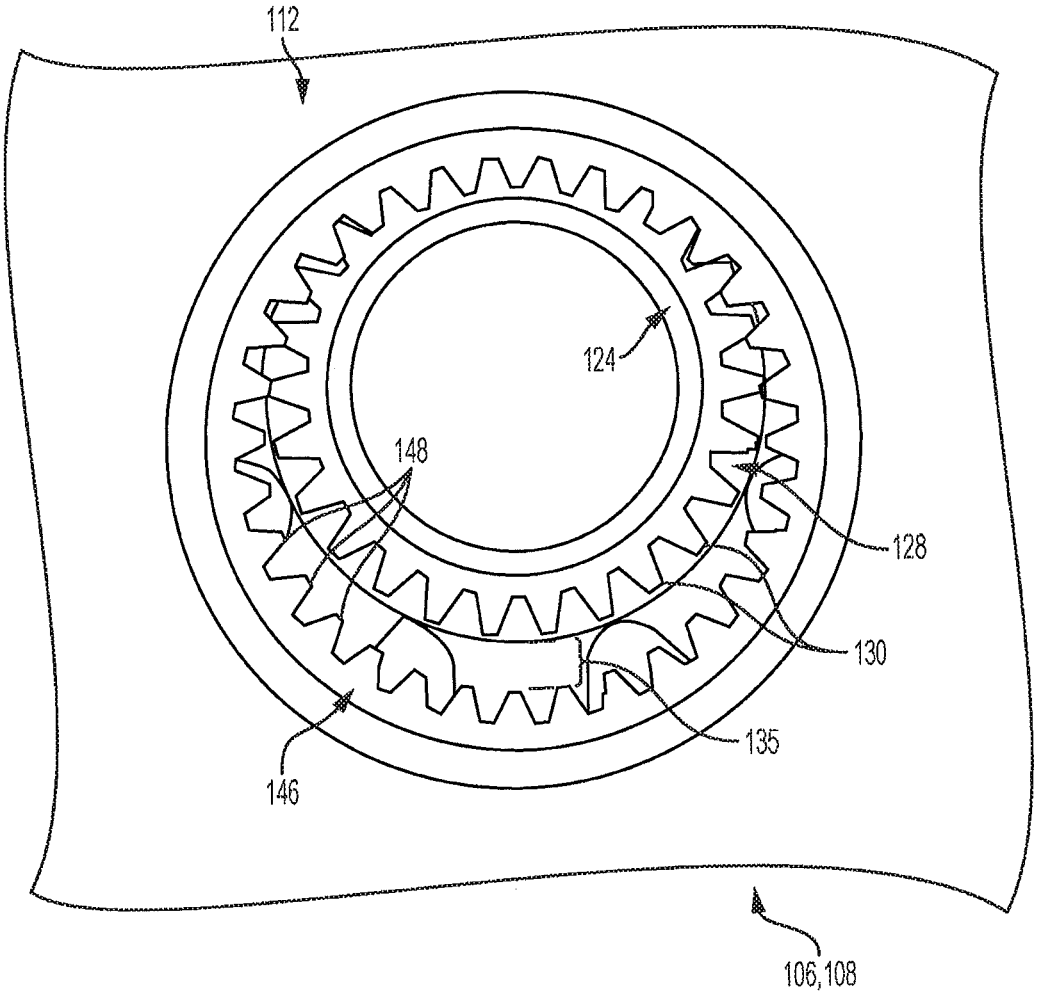
FIG. 8 is an enlarged side elevational view of the frame and the flange of the cable reel illustrated in FIG. 1, showing the inner and outer gears engaged.

The middle flange support 124 and gear member 128 are offset or off-center on the frame such that the distance $d_1$ (FIG. 2) to one end 132 of the frame is longer than the distance $d_2$ (FIG. 2) to the opposite end 135 of the frame. This offset provides a gap 134, as seen in FIG. 8, in the braking mechanism 112. Indicia 136, such as a company name, may be provided on the end 132 of the frame to indicate the longer side, that is distance $d_1$ of the frame to facilitate the orientation of the cable reel 100 in the bag or box.

Each flange 106 and 108 is preferably sized to fit within the outer frame portion 120 of its respective support frame 102 and 104 and is sized to accommodate the cable, such as a cable coil. The cable coil may be, for example, having an outer diameter of 345 mm and an inner diameter of 200 mm and a height of 135 mm. The flanges 106 and 108 are preferably disc-shaped. Each flange has inner and outer surfaces 140 and 142 and a central arbor opening 144. The inner surface 140 of each flange abuts the hub member 110 and the outer surface 142 abuts a respective support frame 102 and 104.

The central arbor opening 144 corresponds to the middle flange support 124 of each respective support frame. The central arbor opening 144 supports the second part of the braking mechanism 112 has seen in FIGS. 3 and 7. The second part of the braking mechanism 112 may be an internal gear member 146 that includes a plurality of annular arranged teeth 148 extending radially inwardly.

The hub member 110 is located between the flanges 106 and 108 and supports the cable coil. The hub member 110 includes a first hub portion 150 (FIGS. 4A and 4B) and a second hub portion 152 (FIGS. 5A and 5B) that are axially aligned and configured to mate with one another. The hub portions 150 and 152 may be formed separately from the respective flanges 106 and 108 and attached thereto or the hub portions 150 and 152 may be formed as one-piece with the respective flanges 106 and 108.

Figure 4A:
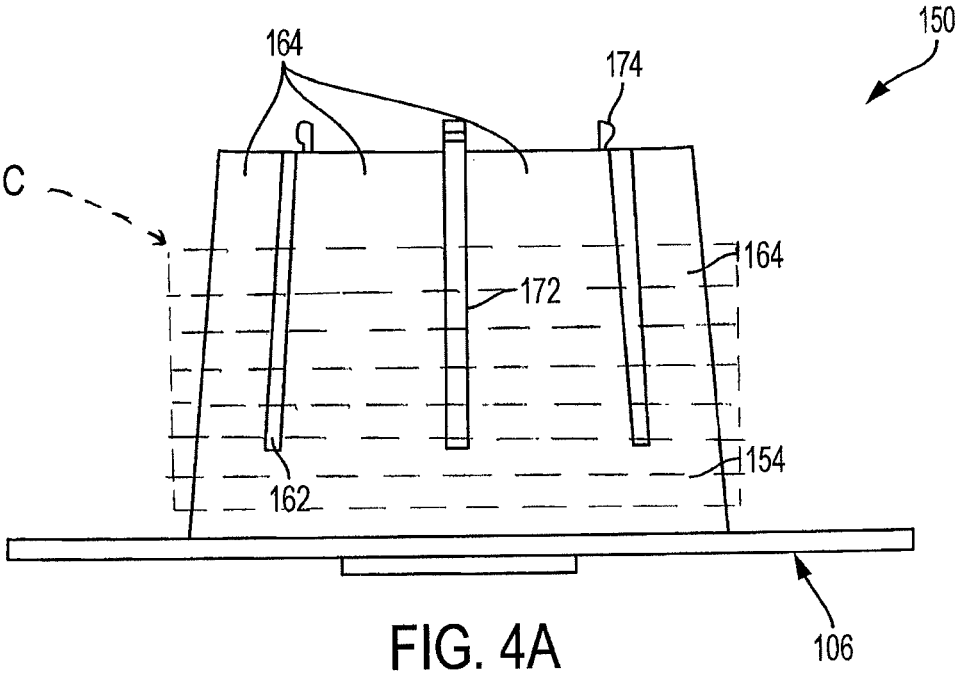
FIG. 4A is a perspective view of a first hub portion of the cable reel illustrated in FIG. 1.
Figure 4B:
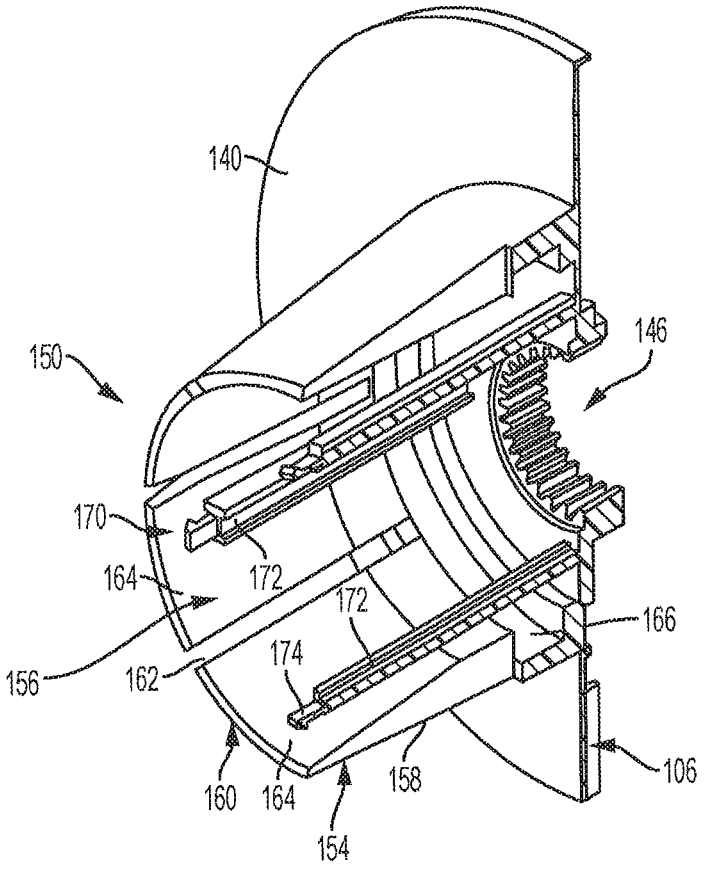
FIG. 4B is a partial perspective view of the first hub portion illustrated in FIG. 4A, showing the bottom hub in cross-section.

As seen in FIGS. 4A and 4B, the first hub portion 150 is preferably the base of the cable reel and provides the main support for the cable. As such, the first hub portion 150 is larger than the second hub portion 152. The first hub portion 150 includes an elongated wall 154 that extends from the inner surface 140 of the first flange 106 and defines an inner area 156 that receives the second hub portion 152. The elongated wall 154 has a tapered outer surface 158 that tapers inwardly from the flange inner surface 140 to the free end 160 of the wall 154. Slots 162 in the elongated wall 154 create flexible segments 164, which engage both the second hub portion 152 and the cable coil to retain the same. A groove 166 (FIG. 4B) may be located at the base of the elongated wall 154 to provide additional flexibility to the segments 164. Any other mechanism may be provided to add flexibility to the segments 164. For example, the segments 164 can be made thinner.

Secondary engagement members 170 may be provided as a back-up to retain the hub portions 150 and 152 together. The secondary engagement members 170 may be, for example, one or more snap arms 172 provided in the inner area 156 that extend from the flange inner surface 140. The one or more snap arms 172 preferably extend beyond the elongated wall 154 of the first hub portion 150, as seen in FIG. 4A, in order to engage the second flange 108. The ends of the snap arms 172 preferably include snap tabs 174 that engage corresponding slots 176 (FIG. 5B) in the second flange 108. Although a snapping engagement is preferred to secure the hub portions 150 and 152 together, any known interlocking mechanism may be used.

Figure 5A:
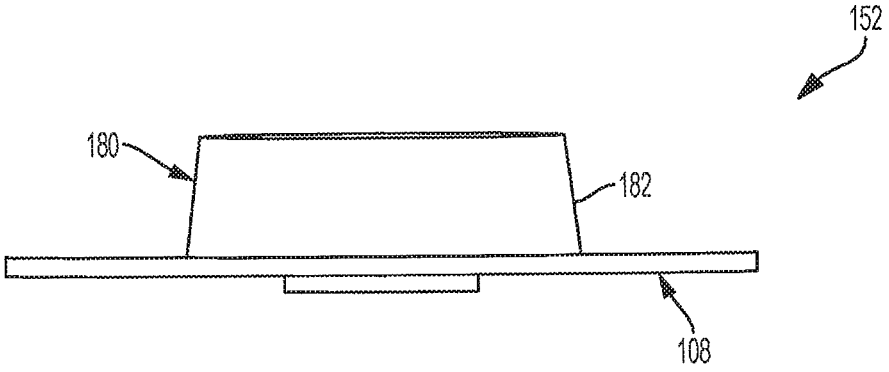
FIG. 5A is an elevational view of a second hub of the cable reel illustrated in FIG. 1.
Figure 5B:
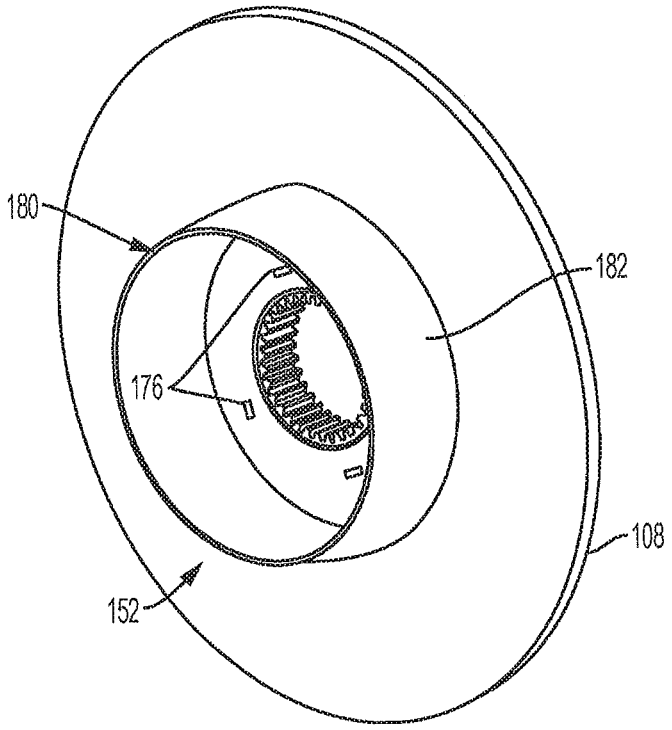
FIG. 5B is a perspective view of the second hub of the cable reel illustrated in FIG. 5A.

As seen in FIGS. 5A and 5B, the second hub portion 152 includes a truncated wall 180 that extends from the inner surface 140 of the second flange 108. The truncated wall 180 has a tapered outer surface 182 that fits inside of the elongated wall 154 of the first hub portion 150 to form a friction fit between the hub portions 150 and 152 and expands the flexible segments 164 of the first hub portion 150.

As seen in FIG. 8, the braking mechanism 112 is provided by meshing the teeth 130 and 148 of the outer and internal gear members 128 and 146. The gap 134 between the teeth 130 and 148 provides clearance for the teeth to slip or jump when the cable is pulled from the reel. The gear members 128 and 146 prevent overpayout of the cable. More specifically, when the cable is pulled from the reel, the flange 106 and 108 rotate, thereby making the gear teeth 148 rotate. The side support 120 is preferably fixed inside of the supporting bag or box and therefore does not rotate. This causes the gear teeth 148 to override meshing gear teeth 130 on the side support 128 which creates friction and provides a braking to the momentum of reel if the cable is pulled too hard. This action also creates a clicking mechanism which in turn prevents overpaying the cable.

The distance of the gap need only be long enough to provide a clearance to have gear teeth 148 to override teeth 130, thereby allowing the braking mechanism to work. This clearance distance could vary depending upon the gear teeth depth, flange hole inner diameter, side support gear depth, and the outer diameter of the middle flange support 124. The gap 134 may be, for example, about ¼ inch.

To install the cable on the cable reel 100, the cable coil C is placed over the first hub portion 150 of the hub member 110 and on the first flange 106 so that the first hub portion 150 extends through the inner diameter of the cable coil. The cable coil C may be prepacked in a plastic shrink wrap or with tie wraps or combination of both without any external structure to support that coil. Next the second hub portion 152 is inserted inside of the first hub portion 150 to frictionally engage the same and expand the flexible segments 164, thereby forcing the flexible segments 164 to engage the inner diameter of the cable coil. The locking tabs 174 are then inserted inside of the slots 176 on the second flange 108 to hold two flanges and hub portions together.

In an example of the present disclosure, the first support frame 102 of the reel 100 is secured to the base of the bag or box, such as by straps, such as via strap 105 (FIG. 1), and the second support frame 104 is secured to the cover or flap of the bag. With the cable coil installed on the hub member 110, the cable coil is inserted into the bag or box between the support frames 102 and 104 in the bag or box. The assembly of the hub portions 150 and 152, the flanges 106 and 108, and the cable coil is preferably inserted into the base of the bag on its side such that the middle flange support 124 of the frame secured to the base of the bag fits inside of the central arbor opening 144 of the flange. Similarly, the middle flange support 124 of the frame secured to the cover of the bag fits inside of the opening 144 of the other flange when the bag is closed. Once the frames 102 and 104 are mated with the flanges 106 and 108, respectively, the operator can then dispense or payout the cable through a cable payout slot or opening in the bag or box. The operator may open the cover of the bag or box to separate the hub portions 150 and 152 by disengaging the snap tabs 174.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as right, left, above, below, upper, lower, top, bottom, linear, arcuate, elongated, parallel, perpendicular, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. Method of installing cable on a cable reel apparatus, comprising the steps of:

prepackaging a pre-wound, reel-less coil of cable for installing on a separable cable reel, the separable cable reel comprising:

a central longitudinal axis, a first flange configured to be rotatably coupled to a first frame, the first flange having opposite inner and outer sides, a second flange separate from the first flange that is configured to be rotatably coupled to a second frame, the second flange having opposite inner and outer sides, and at least one of the first and second flanges including a hub portion extending transversely from the inner side thereof;

instructing a user to releasably couple the first and second flanges to support the pre-wound, reel-lees coil of cable on the hub portion between the first and second flanges along the central longitudinal axis of the separable cable reel;

providing a bag that receives the separable cable reel and the pre-wound, reel-less coil of cable; and instructing the user to place the first frame on a first inner surface of the bag and place the second frame on another second inner surface of the bag, wherein the bag has a base and a cover, and the base includes the first inner surface and the cover includes the second inner surface.

2. The method of claim 1, further comprising the step of instructing the user to decouple the first and second flanges from one another when replacing the pre-wound, reel-less coil of cable once dispensed from the cable reel apparatus.

3. The method of claim 1, wherein the pre-wound, reel-less coil of cable has an inner diameter, and the hub portion is sized to be received in the inner diameter when releasably coupling the first and second flanges for supporting pre-wound, reel-less the coil of cable.

4. The method of claim 1, wherein the step of prepackaging the pre-wound, reel-less coil of cable occurs before the step of releasably coupling the first and second flanges to support the pre-wound, reel-lees coil of cable on the hub portion between the first and second flanges.

5. The method of claim 4, wherein the step of prepackaging the pre-wound, reel-less coil of cable includes wrapping the pre-wound, reel-less coil of cable with plastic.

6. The method of claim 1, further comprising the step of instructing the user to position the bag such that the central longitudinal axis of the separable cable reel is horizontal to dispense cable of the pre-wound, reel-less coil of cable through a payout opening in the base of the bag.

7. The method of claim 1, further comprising the step of instructing the user to close the cover on the base of the bag when releasably coupling the first and second flanges.

8. The method of claim 7, further comprising the step of instructing the user to open the cover from the base of the bag when decoupling the first and second flanges.

9. The method of claim 1, wherein the hub portion is an annular elongated wall.

10. The method of claim 1, wherein the first and second flanges are releasably coupled by a friction fit.

11. Method of installing cable on a cable reel apparatus, comprising the steps of:

providing a bag having a base, a cover, a payout opening sized for dispensing cable, a first frame, and a second frame;

providing a pre-wound, reel-less coil of cable for installing on a separable cable reel, the separable cable reel comprising:

a first flange for positioning on the first frame, the first flange having an inner side and an outer side, the outer side of the first flange for facing the first frame, a second flange separate from the first flange for positioning on the second frame, the second flange having an inner side and an outer side, the outer side of the second flange for facing the second frame, and at least one of the first and second flanges includes a hub portion extending transversely from an inner side thereof;

instructing a user to releasably couple the first and second flanges to support the pre-wound, reel-lees coil of cable on the hub portion between the first and second flanges along a central longitudinal axis of the separable cable reel;

instructing the user to place the separable cable reel with the pre-wound, reel-less coil of cable in the bag;

instructing the user to close the cover on the base of the bag when releasably coupling the first and second flanges; and then after the step of placing the separable cable reel with the pre-wound, reel-less coil of cable in the bag, positioning the bag such that the central longitudinal axis of the separable cable reel is horizontal to dispense cable of the pre-wound, reel-less coil of cable through the payout opening in the bag.

12. The method of claim 11, further comprising the step of instructing the user to decouple the first and second flanges from one another when replacing the pre-wound, reel-less coil of cable once dispensed from the cable reel apparatus.

13. The method of claim 11, further comprising the step of instructing the user to place the first frame on an inner surface of base of the bag and place the second frame on an inner surface of the cover of the bag.

14. The method of claim 11, further comprising the step of prepackaging the pre-wound, reel-less coil of cable prior to placing the coil of cable in the bag.

15. The method of claim 11, further comprising the step of instructing the user to dispense cable of the pre-wound, reel-less coil of cable through the payout opening in the base of the bag after positioning the bag and the cable reel apparatus in the horizontal orientation.

16. The method of claim 11, further comprising the step of instructing the user to open the cover from the base of the bag when decoupling the first and second flanges.

17. Method of installing cable on a cable reel apparatus, comprising the steps of:

providing a bag having a base, a cover, a payout opening sized for dispensing cable, a first frame, and a second frame;

providing a prepackaged pre-wound, reel-less coil of cable for installing on a separable cable reel, the separable cable reel comprising:

a first flange for positioning on the first frame, the first flange having an inner side and an outer side, the inner side of the first flange includes a first hub portion, and the outer side of the first flange for facing the first frame, a second flange separate from the first flange for positioning on the second frame, the second flange having an inner side and an outer side, the inner side of the second flange includes a second hub portion, and the outer side of the second flange for facing the second frame;

instructing a user to releasably couple the first and second hub portions to form a hub member to support the pre-wound, reel-lees coil of cable between the first and second flanges along a central longitudinal axis of the separable cable reel; and instructing the user to place the first frame on an inner surface of the base of the bag and place the second frame on an inner surface of the cover of the bag.

18. The method of claim 17, wherein the first hub portion is an elongated annular wall and the second hub portion is a truncated annular wall.

19. Method of installing cable on a cable reel apparatus, comprising the steps of:

configuring the cable reel apparatus to have:

a bag that includes a base and a cover;

a first frame configured to be received inside the bag such that the first frame is positioned on an inner surface of the base of the bag;

a first flange configured to be removably engaged with the first frame, the first flange being sized to be smaller than the first frame;

a second frame configured to be received inside the bag such that the second frame is positioned on an inner surface of the cover of the bag;

a second flange configured to be removably engaged with the second frame, the second flange being sized to be smaller than the second frame;

a hub member configured to releasably couple the first flange with the second flange, the hub member configured to support a coil of cable; and providing a prepackaged pre-wound, reel-less coil of cable.

20. The method of claim 19, further comprising instructing a user to install the coil of cable on the cable reel apparatus by decoupling the first flange from the second flange, placing the coil of cable on the hub member, and coupling the first flange to the second flange.

* * * * *